United States Patent [19]

Satoh

[11] Patent Number: 4,641,516

[45] Date of Patent: Feb. 10, 1987

[54] BENDING TOOL

[75] Inventor: Masao Satoh, Hatano, Japan

[73] Assignee: Amada Metrecs Company, Limited, Japan

[21] Appl. No.: 658,703

[22] Filed: Oct. 9, 1984

[30] Foreign Application Priority Data

Oct. 13, 1983 [JP] Japan ..... 58-157297[U]

[51] Int. Cl.[4] ..... B21D 37/04

[52] U.S. Cl. ..... 72/481; 72/389; 72/413; 72/415; 72/478

[58] Field of Search ..... 72/381, 386, 389, 390, 72/473, 477, 481, 415, 470, 157, 321, 413, 416, 478

[56] References Cited

U.S. PATENT DOCUMENTS

| | | | |
|---|---|---|---|
| 327,309 | 9/1883 | Phipps | 72/477 |
| 506,234 | 10/1893 | Hinsey | 72/477 |
| 560,515 | 5/1896 | Mason | 72/481 |
| 784,725 | 3/1905 | Yates | 72/389 |
| 1,033,309 | 7/1912 | Fisher | 72/321 |
| 3,276,236 | 10/1966 | McDowell | 72/157 |
| 3,845,655 | 11/1974 | Kreig | 72/470 |

FOREIGN PATENT DOCUMENTS

| | | | |
|---|---|---|---|
| 1808204 | 5/1970 | Fed. Rep. of Germany | 72/477 |
| 2608159 | 9/1977 | Fed. Rep. of Germany | 72/389 |

*Primary Examiner*—Francis S. Husar
*Assistant Examiner*—David B. Jones
*Attorney, Agent, or Firm*—Wigman & Cohen

[57] ABSTRACT

The present invention relates to a bending press having an upper and a lower tool disposed on a frame, together with a hydraulic ram for bringing the upper and lower tools together. The upper tool comprises a fixed punch of an arcuate shape, and has a plurality of detachable punches that are detachably mounted on the fixed punch for changing the external shape of the punch.

6 Claims, 5 Drawing Figures

BENDING TOOL

BACKGROUND OF THE INVENTION

1. Field of the Invention

The present invention relates to a forming tool for carrying out a bending process on a plate-shaped workpiece, or, more precisely stated, to a tool which forms a workpiece into the form of an arc.

2. Description of the Prior Art

Bending presses, bending rolls, ring formers and the like are commonly known as devices which form a plate-shaped workpiece into an arc by bending. Generally, in a fabricating machine, a fabricating section of which the cross-sectional shape is in the form of an arc is used as a bending tool, and the workpiece is inserted between this tool and an opposing tool. The arc-shaped tool is then pressed against the workpiece to carry out the bending process.

In the case where the workpiece is processed by bending into the shape of an arc, there is always a large amount of deviation after the actual bending process is carried out because there is a variation in the elastic displacement volume of the workpiece after the bending process (usually referred to as spring back volume), depending on the type of work piece and processing conditions, even though the radius of the arc-shaped part of the opposing tool is identical to the bending radius of the workpiece after fabrication.

Accordingly, in the case where the bending radius of the workpiece varies, the actual bending radius must be reportedly measured while repeating the bending process, and it is necessary to select and mount an arc-shaped tool of the desired radius to revise the bending radius every time.

That is, it is necessary to manufacture multiple varieties of arc-shaped tools because of the variation in the bending radius when fabricating the workpiece.

Accordingly, in a conventional bending tool, it is necessary that a larger number of upper tools, each having a different radius for the arc-shaped part of the fabricating section, be assembled as a set, and a large storage area is required to store the upper tools when they are not being used. In addition, because the upper tool is large and heavy, it is not only dangerous to change, but requires a great deal of effort. A quick change is very difficult to accomplish.

SUMMARY OF THE INVENTION

A first object of the present invention is to provide a bending tool with which it is possible to carry out the fabrication of a workpiece into the shape of an arc, at many different radii.

A second object of the present invention is to provide a bending tool with which it is possible to bend a workpiece into an arc shape at many different radii, and in which the required radius can quickly be accommodated.

A third object of the present invention is to provide a bending tool for which a minimum amount of storage space is required when the tool is not in use.

A fourth object of the present invention is to provide a bending tool which does not cause processing damage to the surface of the workpiece during fabrication.

In order to accomplish these objects in the present invention, a fixed punch, which has its outer peripheral surface formed into the shape of an arc, is provided on the lower edge of the shank section of the upper tool, and, opposing this fixed punch, a unit of detachable punches of a semicylindrical form different in diameter are mounted in nested layers in a freely removable and exchangeable manner.

BRIEF DESCRIPTION OF THE DRAWINGS

These and other objects, features and advantages of the present invention will become more apparent from the following description of a preferred embodiment taken in conjunction with the accompanying drawings, in which.

DESCRIPTION OF THE PREFERRED EMBODIMENTS

Figure 1:
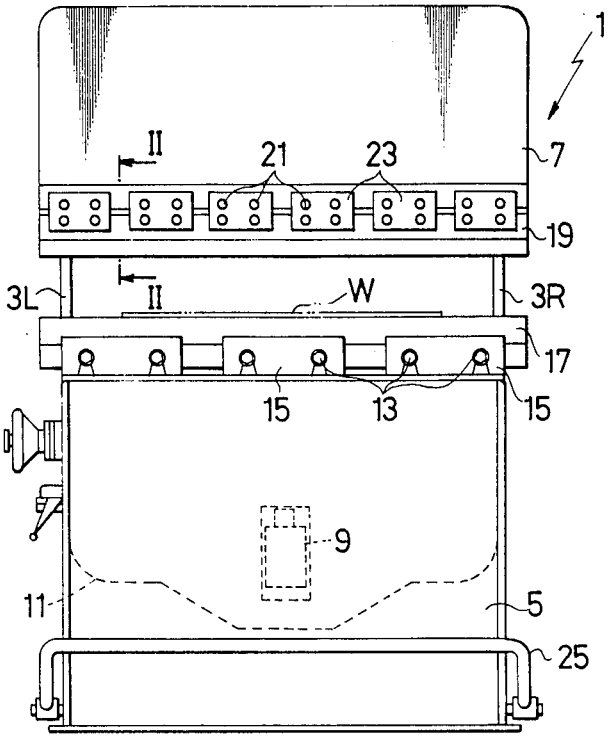
FIG. 1 is a front view showing a bending press provided with a tool which is a preferred embodiment of the present invention.

Referring now to FIG. 1, as one example of the bending equipment which performs the bending operation on a plate-shaped workpiece W, a bending press 1 is shown in which the workpiece is loaded between an upper tool and a lower tool and the bending operation on the workpiece is carried out according to the relationship between these upper and lower tools. The bending press 1 comprises a plurality of C-shaped side frames 3R and 3L, provided in the lateral direction, a lower frame 5 which is connected to the lower sides of both side frames 3R and 3L, and an upper frame 7 which has both sides supported by the upper parts of the side frames 3R and 3L.

On the lower frame 5 of the bending press 1, a ram 11 which is moved in the vertical direction by means of a vertically travelling cylinder 9 built in by a commonly known means, is supported in a vertically extendable manner.

A lower tool 17 which extends in the lateral direction is mounted in a freely detachable and exchangeable manner by means of a fixed plate 15 and a plurality of securing means 13, such as bolts, on the upper part of the ram 11. An upper tool 19, which acts in concert with the lower tool 17 to carry out the bending process on the plate-shaped workpiece W, is mounted in a freely detachable and exchangeable manner by means of a fixed plate 23 and a plurality of securing means 21 on the lower part of the upper frame 7. In addition, a foot pedal 25 for the vertical operation of the ram 11 is mounted on the lower frame 5 and controls the vertically travelling cylinder 9 by a commonly known hydraulic control means.

In the bending press 1 which has the configuration described above, after the workpiece W has been positioned on the lower tool 17, the foot pedal 25 is pressed down. This causes the ram 11 to move in the vertical direction by means of the hydraulic circuit. The bending process is then carried out on the workpiece W through the relationship between the lower tool 17 and the upper tool 19.

Figure 2:
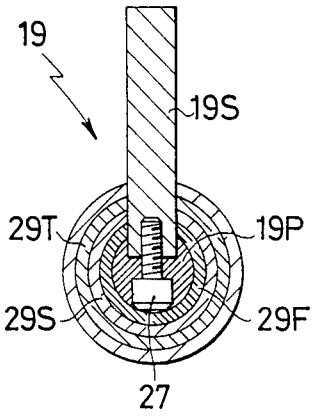
Fig. 2 is an enlarged cross-sectional view taken along the line II—II in FIG. 1.
Figure 3:
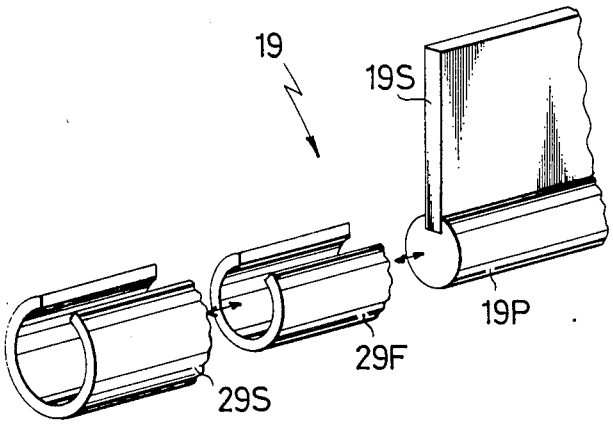
FIG. 3 is an exploded perspective view of a tool according to the present invention.

Referring now to FIG. 2 and FIG. 3, the upper tool 19 is provided with a plate-shaped shank 19S on the upper frame 7, by means of the securing means 21 and the fixed plate 23. A fixed punch 19P is mounted on the upper portion of the shank section 19S, by means of a plurality of securing means 27, such as bolts. A plurality of semicylindrically shaped detachable punches 29F, 29S, 29T of different external diameters, are provided so that, when the workpiece W is being formed into the shape of an arc, it is possible to utilize many different radii to accommodate the requirements of the fabricating process.

The semicylindrical detachable punches 29F, 29S, 29T, have adequate strength so that no distortion is produced from repeated bending operations, which could cause the semicylindrical opening to spread outward. These punches are fabricated from a material of construction which is not distorted from the heat generated as a result of the frictional resistance produced when the workpiece W is subjected to the bending process. Polycarbonate is used because of its excellent resistance to chemical solvents such as grease. However, the fabrication is not limited to this material of construciton. There are other materials which are also completely satisfactory.

In addition, the semicylindrically shaped detachable punches 29F, 29S, 29T opposing are constructed in different colors to distinguish between the different radii.

The first detachable punch 29F has an internal radius which is the same as the external radius of the fixed punch 19P, and this detachable punch 29F is freely removable in the longitudinal direction of the fixed punch 19P. In addition, the second detachable punch 29S has an internal radius which is the same as the external radius of the first detachable punch 29F, and this detachable punch 29S is freely removable in the longitudinal direction of the detachable punch 29F. In the same way, the third detachable punch 29T has an internal radius which is the same as the external radius of the second detachable punch 29S, and this detachable punch 29T is freely removable punch 29S. In other words, the detachable punches 29F, 29S, 29T are nested so that each is freely removable in the longitudinal direction.

Accordingly, when bending the workpiece W into the shape of an arc, since the detachable punches 29F, 29S, 29T opposing the fixed punch 19P can be identified by coloring and are nested, a unit of the detachable punches is capable of accommodating the requirements for many different bending radii. When the detachable punches 29F, 29S, 29T opposing the fixed punch 19P are nested, removal and exchange can be easily carried out because each of these punches is arc-shaped with its light weight. In addition, no abrasion damage is produced even in the case where workpieces of materials such as stainless steel, aluminium, and copper are fabricated. Furthermore, when any of the detachable punches 29F, 29S, 29T are not being used, it is possible to store them in the nested status, so that a large storage space is unnecessary.

Figure 4:
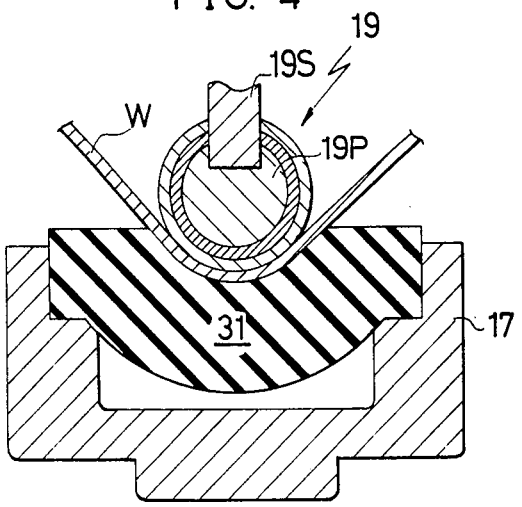
FIG. 4 and FIG. 5 are cross-sectional views, each showing a different lower tool used for carrying out the bending operation on the workpiece in cooperation with the upper tool according to the present invention.
Figure 5:
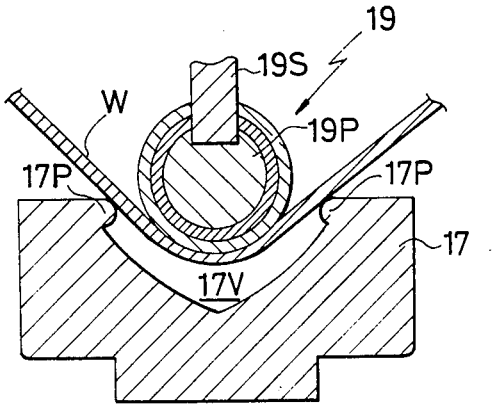

Either a unit of the configuration where a flexible pad 31 made of a material such as urethane rubber is employed, as shown in FIG. 4, or, a unit of the configuration where a projecting section 17P projects in the inward direction of both shoulder sections of a V-groove 17V, as shown in FIG. 5, is used as the lower tool 17 which acts in concert with the upper tool 19 to form the workpiece W into the shape of an arc.

As can be understood from the above explanation of this embodiment of the present invention, the semicylindrical detachable punches 29F, 29S, 29T which oppose the fixed punch 19P provided on the upper tool 19, are nested in a freely removable manner. Because of this configuration it is possible to easily accommodate the radius of the arc-shaped section which does the bending. Also, when the detachable punches 29F, 29S 29T are not in use, they can be nested and stored, with the benefit that the required storage area is small, and storage is made easy.

Although a preferred form of the present invention has been illustrated and described, it should be understood that the device is capable of modification by one skilled in the art without departing from the principles of the invention. Accordingly, the scope of the invention is to be limited only by the claims appended hereto.

What is claimed is:

1. A bending tool for a press comprising:

a fixed punch having its external peripheral surface of an arcuate shape and mounted on the lower edge of a shank section of the press, the diameter of which is greater than the width of said shank section, means for rigidly fixing the fixed punch to the shank section, and a plurality of semicylindrical punches which are detachably and telescopically mounted on the fixed punch.

2. The bending tool of claim 1, wherein said semicylindrical punches are slideably mounted on the fixed punch or on one another so that they can be removed in the longitudinal direction of the fixed punch.

3. The bending tool of claim 2, wherein said semicylindrical punches are made of heat- and friction-resisting material.

4. The bending tool of claim 3, wherein said semicylindrical punches are made of polycarbonate.

5. A bending press, comprising:

a frame;

an upper tool and a lower tool disposed on the frame;

means for bringing the upper and lower tools together;

one of said upper and lower tool comprising a shank section, a fixed punch having an arcuate shaped outer surface, the diameter of which is greater than the width of said shank section, and means for rigidly fixing said fixed punch to said shank section; and a plurality of detachable punches that are detachably and telescopically mounted on said fixed punch.

6. The bending tool of claim 1, wherein the semicylindrical punches are telescopically rested on the fixed punch in order of increasing radius.

* * * * *

UNITED STATES PATENT AND TRADEMARK OFFICE

CERTIFICATE OF CORRECTION

PATENT NO. : 4,641,516

DATED : February 10, 1987

INVENTOR(S) : Masao SATOH

It is certified that error appears in the above-identified patent and that said Letters Patent is hereby corrected as shown below:

IN THE CLAIMS:

Claim 6, column 4, line 59, "rested" should be --nested--.

Signed and Sealed this

Eighteenth Day of August, 1987

*Attest:*

DONALD J. QUIGG

*Attesting Officer*

*Commissioner of Patents and Trademarks*